United States Patent [19]

Gossett

[11] Patent Number: 4,967,900

[45] Date of Patent: Nov. 6, 1990

[54] GARBAGE DISPOSAL SYSTEM

[76] Inventor: Dianne Gossett, 560 Riverside Dr., Apt. 20B, New York, N.Y. 10027

[21] Appl. No.: 407,970

[22] Filed: Sep. 15, 1989

[51] Int. Cl.[5] ..... B65D 1/24; B65D 21/02

[52] U.S. Cl. ..... 220/404; 220/17; 220/20

[58] Field of Search ..... 220/1 R, 1 T, 403, 404, 220/20, 22; 493/931; 383/37, 38

[56] References Cited

U.S. PATENT DOCUMENTS

| | | | |
|---|---|---|---|
| 2,688,435 | 9/1954 | Vogt | 383/37 |
| 2,736,454 | 2/1956 | McConnell | 220/404 X |
| 3,893,615 | 7/1975 | Johnson | 220/404 X |
| 3,977,450 | 8/1976 | Schampier | 220/404 X |
| 4,524,458 | 6/1985 | Pongrass et al. | 383/33 |
| 4,750,638 | 6/1988 | Sosower | 220/1 T |
| 4,750,639 | 6/1988 | Schaerer | 383/38 X |
| 4,765,579 | 8/1988 | Robbins, III et al. | 220/1 T X |
| 4,834,262 | 5/1989 | Reed | 220/1 T X |

FOREIGN PATENT DOCUMENTS

| | | | |
|---|---|---|---|
| 0194339 | 9/1986 | European Pat. Off. | 220/1 T |
| 3625995 | 2/1988 | Fed. Rep. of Germany | 220/1 T |
| 1324683 | 7/1973 | United Kingdom | 220/1 T |

*Primary Examiner*—Stephen Marcus

*Attorney, Agent, or Firm*—Iman Abdallah

[57] ABSTRACT

A household garbage collection system providing means for pre-sorting of refuse and selective disposal of the sorted garbage. The system generally comprises a conventional type garbage can and a sectional frame assembly disposed on the top of the garbage can, the frame assembly providing means for attachment of a plurality of garbage sacks which may be selectively removed and disposed of.

3 Claims, 2 Drawing Sheets

GARBAGE DISPOSAL SYSTEM

BACKGROUND OF THE INVENTION

The present invention generally relates to means for disposal of household garbage. More particularly, the present invention relates to means for pre-sorting household garbage to facilitate separate disposal of different types of garbage.

The substantial amounts of garbage generated today has lead to increased efforts by public and private refuse utilities to find alternative means of disposal. Recycling, composing and ultimate disposal systems designed for particular types of refuse have created a need for more sorting of garbage prior to ultimate disposal. In some states households are even required to sort garbage prior to pickup for separate collection and transportation to the ultimate disposal sites.

Various sorting means have been disclosed in the prior art including the utilization of separate containers having different colored garbage sacks to correspond to different types of refuse. Such a system of pre-sorting of garbage utilizes large areas of space for garbage disposal and is not readily adaptable to present household garbage disposal means. In U.S. Pat. No. 4,750,639 to Schaerer a household garbage disposal system is disclosed which utilizes a garbage sack formed with a plurality of sack sections to facilitate pre-sorting of household garbage. The utility of the Schaerer invention for pre-sorting of household garbage is limited because it does not provide means for separate removal and replacement of the various sections of the garbage sack. Since the volume displaced in a garbage sack varies tremendously for different types of refuse the Schaerer invention will result in some sections being only partially filled when removed. Thus the garbage sack will not be efficiently utilized before being disposed of.

SUMMARY OF THE INVENTION

The household garbage disposal system of the present invention provides means for pre-sorting of refuse in a manner that permits the selective removal and replacement of the separated garbage. The present invention generally comprises a sectioned frame assembly which attaches to the top of a disposal container, and a plurality of garbage sacks which attach to the various sections of the frame assembly. Separate garbage sacks or garbage sacks having separately detachable sections may be utilized with the frame assembly of the present invention.

An object of the present invention is to provide a garbage disposal system which facilitates the pre-sorting of refuse of different types.

It is also an object of the present invention to provide a pre-sorting garbage disposal system that can be utilized within the limited spaces generally reserved for household garbage containers.

Another object of this invention is to provide a sectioned garbage disposal system which permits the selective removal and replacement of the various sections of the system.

These and other objects and advantages of the present invention will be apparent to those skilled in the art from the following drawings, description of a preferred embodiment, and claims.

DESCRIPTION OF THE PREFERRED EMBODIMENT

Figure 1:
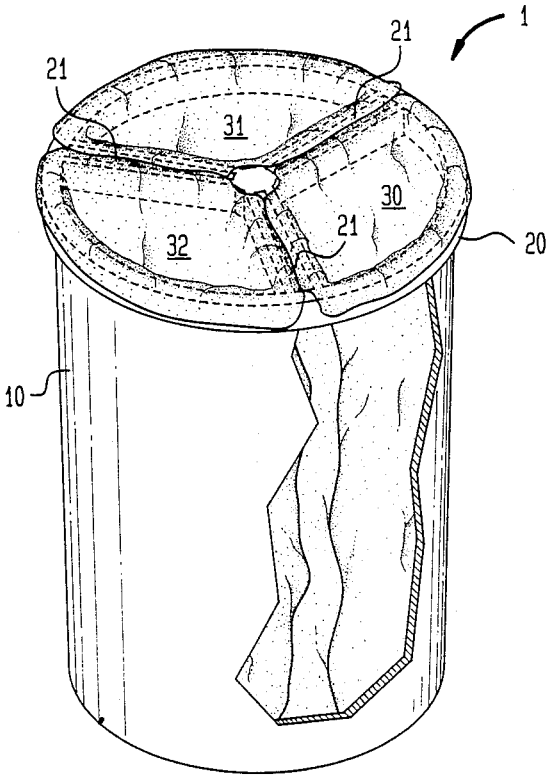
FIG. 1 is a partially fragmented perspective view of the garbage disposal system of the present invention.

FIG. 1 illustrates in a partially-fragmented perspective view the garbage disposal system 1 of the present invention. The disposal system 1 generally comprises a disposal container 10, a sectioned frame assembly 20 and a plurality of garbage sacks shown in the preferred embodiment to be three sacks indicated by the numerals 30, 31 and 32. Disposal container 10 is a conventional wide mouth trash can. Frame assembly 20 comprises a circular frame member having three sets of paired spokes 21 which divide the frame assembly 20 into three sections. Frame assembly 20 may be formed with any plurality of sections and is shown in the preferred embodiment to have three sections for illustration purposes only.

Figure 2:
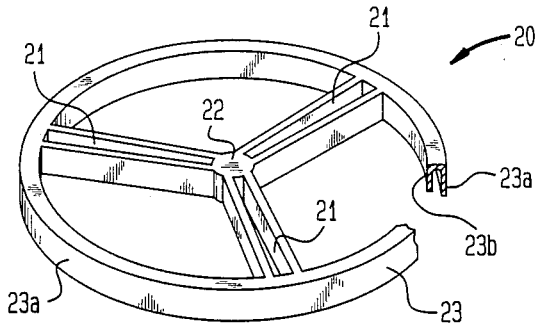
FIG. 2 is a perspective view of the frame assembly of the present invention.

As best seen in the perspective view of the frame assembly 20 shown in FIG. 2, the paired spokes 21 extend from a central hub 22 to distinct points on the circumferential rim 23 of the frame assembly 20. Paired spokes 21 are substantially flat bar members marginally displaced from each other to facilitate attachment of the garbage sacks 30, 31, 32 as hereinafter described. The circumferential rim 23 has an inverted-U-shaped cross-section, the outer lip **23*a* of said rim 23 having a greater width than the inner lip 23*b*. When the frame assembly 20 is attached to disposal container 10 the top edge of the mouth of the container 10 snugly fits between the outer lip 23*a* and inner lip 23*b* of the rim 23**.

Referring again to FIG. 1 the garbage sacks 30, 31, 32 can be seen to be loosely disposed within container 10. Each garbage sack 30, 31, 32 attaches to the respective sections formed by frame assembly 20. The top of each sack 30, 31 , 32 fits over the spokes 21 and the top of the portion of rim 23 which define the respective section of frame assembly 20. The portions of the sacks 30, 31, 32 which fit over spokes 21 are tucked between the spaces formed by the displaced paired spokes 21. By having the sacks 30, 31, 32 loosely disposed within the entire volume of container 10 each sack can be more efficiently utilized. For example, as cans or bottles are pre-sorted and disposed within a section of the disposal system and more finely graded refuse is disposed within another section, the sacks receiving the cans or bottles are allowed to freely expand throughout the volume of the container 10 as needed. The sack 30, 31 or 32 which is more quickly filled is then removed without requiring a partially used garbage sack to be removed before being completely filled, thereby more efficiently using the entire volume of the container 10.

In lieu of separate garbage sacks, a plurality of sacks joined at perforated edges along the top portion of the sacks may be utilized. Also, the garbage sacks 30, 31, 32 may be formed with an outwardly ballooning body to facilitate use of the entire volume of the container 10.

Therefore in view of the foregoing, I claim:

1. A garbage disposal system providing means for pre-sorting of refuse components comprising:

a disposal container, a unitary sectioned frame assembly including means to attach said frame assembly to the top edge of said disposal container and means to secure a garbage sack to each section of said frame assembly, said frame assembly comprising a peripheral rim forming said first means and a frame member forming said second means, said frame member having a plurality of marginally displaced paired spokes which extend from a central hub to distinct points on said peripheral rim, said peripheral rim having an inverted-U-shaped cross-section including an outer lip of greater width than its inner lip, said frame assembly being attachable to said disposal container by snug engagement of the mount of said disposal container between said outer lip and said inner lip of said peripheral rim, and a plurality of garbage sacks removably attachable to said frame assembly by tucking the top edge of adjacently disposed sacks between marginal displaced paired spokes of said frame member.

2. A garbage disposal system as described in claim 1 wherein said plurality of garbage sacks are formed with an outwardly ballooning body to provide means for complementary displacement of adjacently disposed garbage sacks.

3. A garbage disposal system providing means for pre-sorting of refuse components comprising a disposal container;

a unitary sectioned frame assembly comprising a frame member having a peripheral rim and a plurality of marginally displaced paired spokes disposed in side-by-side relationship within the horizontal plane of said peripheral rim which extend from a central hub to distinct points on the peripheral rim of said frame member, said peripheral rim having an inverted-U-shaped cross-section including an outer lip of greater width than its inner lip, said frame assembly being attachable to said disposal container by snug engagement of the mouth of said disposal container between said outer lip and said inner lip of said rim, and a plurality of garbage sacks removably attachable to said frame assembly by tucking the top edge of said sacks between each pair of spokes of said frame member, said plurality of garbage sacks being formed with an outwardly ballooning body.

* * * * *